US010386758B2

(12) United States Patent
Ishiguro et al.

(10) Patent No.: US 10,386,758 B2
(45) Date of Patent: Aug. 20, 2019

(54) IMAGE FORMING APPARATUS

(71) Applicant: CANON KABUSHIKI KAISHA, Tokyo (JP)

(72) Inventors: Keita Ishiguro, Kawasaki (JP); Masanobu Tanaka, Kashiwa (JP); Suguru Takeuchi, Funabashi (JP); Asuna Fukamachi, Kashiwa (JP); Oki Kitagawa, Nagareyama (JP); Yasuharu Toratani, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/027,032

(22) Filed: Jul. 3, 2018

(65) Prior Publication Data

US 2019/0025736 A1 Jan. 24, 2019

(30) Foreign Application Priority Data

Jul. 21, 2017 (JP) ..... 2017-141666
May 24, 2018 (JP) ..... 2018-099406

(51) Int. Cl.
*G03G 15/00* (2006.01)
*G03G 15/20* (2006.01)
(Continued)

(52) U.S. Cl.
CPC ..... *G03G 15/20* (2013.01); *B41J 29/377* (2013.01); *G03G 15/5083* (2013.01);
(Continued)

(58) Field of Classification Search
CPC ..... G03G 15/20; G03G 15/5083; G03G 15/6552; G03G 15/6573; G03G 21/14; B41J 29/377
See application file for complete search history.

(56) References Cited

U.S. PATENT DOCUMENTS

2010/0290825 A1* 11/2010 Iguchi ..... B65H 31/10 399/405
2015/0029518 A1* 1/2015 Tashiro ..... G03G 15/01 358/1.1

(Continued)

FOREIGN PATENT DOCUMENTS

JP 2004109732 A 4/2004
JP 2008116799 A 5/2008
JP 2008242335 A 10/2008

*Primary Examiner* — Rodney A Bonnette
(74) *Attorney, Agent, or Firm* — Canon U.S.A., Inc. IP Division

(57) ABSTRACT

An image forming apparatus includes an image forming unit, a fixing unit, a sheet discharge unit to stack sheets, an acquisition unit, and a controller. The fixing unit fixes a toner image formed on a sheet by the image forming unit. The acquisition unit acquires information corresponding to a maximum toner application amount per unit area of the formed toner image. The controller controls the number of image formations on the sheets per unit time based on the acquired information. The controller executes a first job with a first number of image formations on the sheets per unit time during a period from an Lth sheet to an Mth sheet in the first job, and executes a second job with a second and smaller number of image formations on the sheets per unit time during the period from the Lth to the Mth sheet in the second job.

9 Claims, 11 Drawing Sheets

(51) Int. Cl.
*B41J 29/377* (2006.01)
*G03G 21/14* (2006.01)

(52) U.S. Cl.
CPC ..... *G03G 15/6552* (2013.01); *G03G 15/6573* (2013.01); *G03G 21/14* (2013.01)

(56) References Cited

U.S. PATENT DOCUMENTS

| | | | | |
|---|---|---|---|---|
| 2017/0107071 | A1* | 4/2017 | Agata ..... | B65H 29/70 |
| 2017/0343943 | A1* | 11/2017 | Shibuya ..... | G03G 15/50 |

* cited by examiner

FLOWCHART FOR THROUGHPUT CONTROL ACCORDING TO FIRST EXEMPLARY EMBODIMENT

BLOCK DIAGRAM ILLUSTRATING CONTROLLER UNIT 100 AND CONTROL CIRCUIT UNIT 90

RELATIONSHIP AMONG SHEET BUNDLE BOTTOM TEMPERATURE T, SHEET BUNDLE STACKING AMOUNT H, AND ALLOWABLE MAXIMUM APPLICATION AMOUNT F(th) OF TONER

RELATIONSHIP BETWEEN NUMBER (POSITION) OF STACKED SHEET BUNDLES FROM BOTTOM OF STACKED SHEET BUNDLES AND STACKED SHEET BUNDLE TEMPERATURE AT NUMBER OF STACKED SHEET BUNDLES

CALCULATION RESULT OF ALLOWABLE MAXIMUM APPLICATION AMOUNT F(x) AT EACH NUMBER OF STACKED SHEETS WHEN TOTAL NUMBER OF OUTPUT SHEETS N = 800

FLOWCHART FOR THROUGHPUT CONTROL ACCORDING TO SECONDARY EXEMPLARY EMBODIMENT

IMAGE FORMING APPARATUS

BACKGROUND OF THE INVENTION

Field of the Invention

The present disclosure relates to an image forming apparatus that forms a toner image on a recording sheet (recording material).

Description of the Related Art

An image forming apparatus, such as a copying machine, a printer, or a facsimile machine, which employs an electrophotographic process, or a multifunction peripheral having these functions, forms an unfixed toner image on a recording sheet by using image forming processes such as charging, exposure, development, and transfer. Then, heating and pressurizing processing is performed by a fixing device, to thereby fuse and fix the unfixed toner image formed on the recording sheet.

Recently, there have been a demand for further speeding up the processing in an image forming apparatus. Accordingly, the following measures have been taken to increase the image forming speed of the image forming apparatus. Specifically, for example, a material having a low melting point is selected and used as toner, and as a control device for the fixing device (fixing unit), a conveyance interval of recording sheets is reduced and a fixing temperature is increased so as to fix toner instantaneously onto each recording sheet.

However, if the toner is heated and fixed onto each recording sheet under the above-described conditions and recording sheets are sequentially stacked on a sheet discharge unit, a large number of high-temperature recording materials, which have come out of the fixing device, are sequentially stacked on the same location, so that the toner formed on each recording sheet after fixing is maintained at a high temperature on the sheet discharge unit.

If the fixed toner is maintained at a high temperature and the temperature of the toner reaches a toner softening point or higher, the toner fixed onto each recording sheet once is softened again, so that the toner may adhere to other recording sheets stacked on top of the sheet or may adhere to the toner formed on the top recording sheet in a case of printing a double-sided image. This causes issues that, for example, the stacked recording sheets are bonded together, and the toner formed on each recording sheet onto which the toner is fixed is peeled off and other recording sheets are stained with the toner, which causes a defect in fixed images.

Accordingly, in order to prevent adhesion between stacked recording sheets, the following techniques are generally proposed. For example, there is a technique for prohibiting a subsequent image forming operation, reducing a fixing speed, and reducing a fixing temperature until a recording sheet temperature reaches a predetermined value or lower by using a temperature detection unit for detecting the temperature of recording sheets stacked on the sheet discharge unit. Further, in order to increase a time to be able to use for cooling recording sheets on the sheet discharge unit, there is a technique for, for example, increasing a conveyance interval, increasing a conveyance distance, and providing a cooling mechanism for cooling recording sheets to be stacked on the sheet discharge unit.

With the techniques described above, the temperature of recording sheets stacked on the sheet discharge unit is maintained below a toner softening point. As a result, the adhesion between stacked recording sheets can be prevented.

An adhesion prevention unit for preventing adhesion between sheets discussed in Japanese Patent Application Laid-Open No. 2008-116799 includes a temperature detection unit that detects the temperature of recording sheets stacked on a tray, which is a sheet discharge unit, and controls the throughput and fixing temperature of a fixing device based on the temperature information. The adhesion prevention unit also includes a stacking amount detection unit that detects the stacking amount of recording sheets stacked on the tray, and controls the throughput and fixing temperature of the fixing device based on the stacking amount information.

An adhesion prevention unit for preventing adhesion between recording sheets discussed in Japanese Patent Application Laid-Open No. 2008-242335 includes a temperature detection unit that detects the temperature of a sheet discharge member for discharging recording sheets onto a tray, which is a sheet discharge unit, and controls the throughput and fixing temperature of a fixing device based on the temperature information.

An adhesion prevention unit for preventing adhesion between recording sheets discussed in Japanese Patent Application Laid-Open No. 2004-109732 absorbs heat from recording sheets after fixing and cools the recording sheets by using a cooling roller disposed on a downstream side of a fixing device in a recording sheet conveyance direction and a cooling unit for cooling the cooling roller, thereby preventing adhesion between recording sheets.

However, the application amount of toner on a recording sheet is not taken into consideration in any of the techniques discussed in Japanese Patent Application Laid-Open Nos. 2008-116799, 2008-242335, and 2004-109732. Therefore, even in a case where the application amount of toner on each recording sheet is low enough not to cause an occurrence of adhesion between recording sheets, there is a possibility of occurrence of inadvertent deterioration in throughput and deterioration in productivity.

SUMMARY OF THE INVENTION

The present disclosure is directed to an image forming apparatus capable of preventing recording sheets stacked on a sheet discharge unit from adhering to each other, while preventing a deterioration in productivity. In an example, a controller is configured to control the number of image formations on the sheets per unit time based on information corresponding to a maximum toner application amount per unit area of the toner image formed on the sheet.

According to an aspect of the present invention, an image forming apparatus includes an image forming unit configured to form a toner image on a sheet, a fixing unit configured to heat and fix the toner image formed on the sheet by the image forming unit, a sheet discharge unit capable of stacking a plurality of sheets to be discharged through the fixing unit, an acquisition unit configured to acquire information corresponding to a maximum toner application amount per unit area of the toner image formed on the sheet, and a controller configured to control the number of image formations on the plurality of sheets per unit time based on the information acquired by the acquisition unit, wherein, in a case where a first job for forming a first toner image having a first amount as the maximum toner application amount per unit area on each of N sheets and stacking the N sheets on the sheet discharge unit is executed, the controller executes the first job with a first number of image formations on the plurality of sheets per unit time during a period from an Lth sheet to an Mth sheet in the first job, where L, M, and N are natural numbers and L<M<N holds, and wherein, in a case where a second job for forming a second toner image having a second amount more than the first amount as the maximum toner application amount per unit area is formed on each of the N sheets by the image forming unit and stacking the N sheets on the sheet discharge unit is executed, the controller executes the second job with a second number of image formations less than the first number of image formations of the plurality of sheets per unit time during the period from the Lth sheet to the Mth sheet in the second job.

Further features of the present invention will become apparent from the following description of embodiments with reference to the attached drawings.

DESCRIPTION OF THE EMBODIMENTS

Embodiments will be described in detail below with reference to the accompanying drawings. However, components described in the embodiments are illustrated by way of example only, and the present disclosure is not limited only to the components described in the embodiments.

<Image Forming Apparatus>

Figure 2:
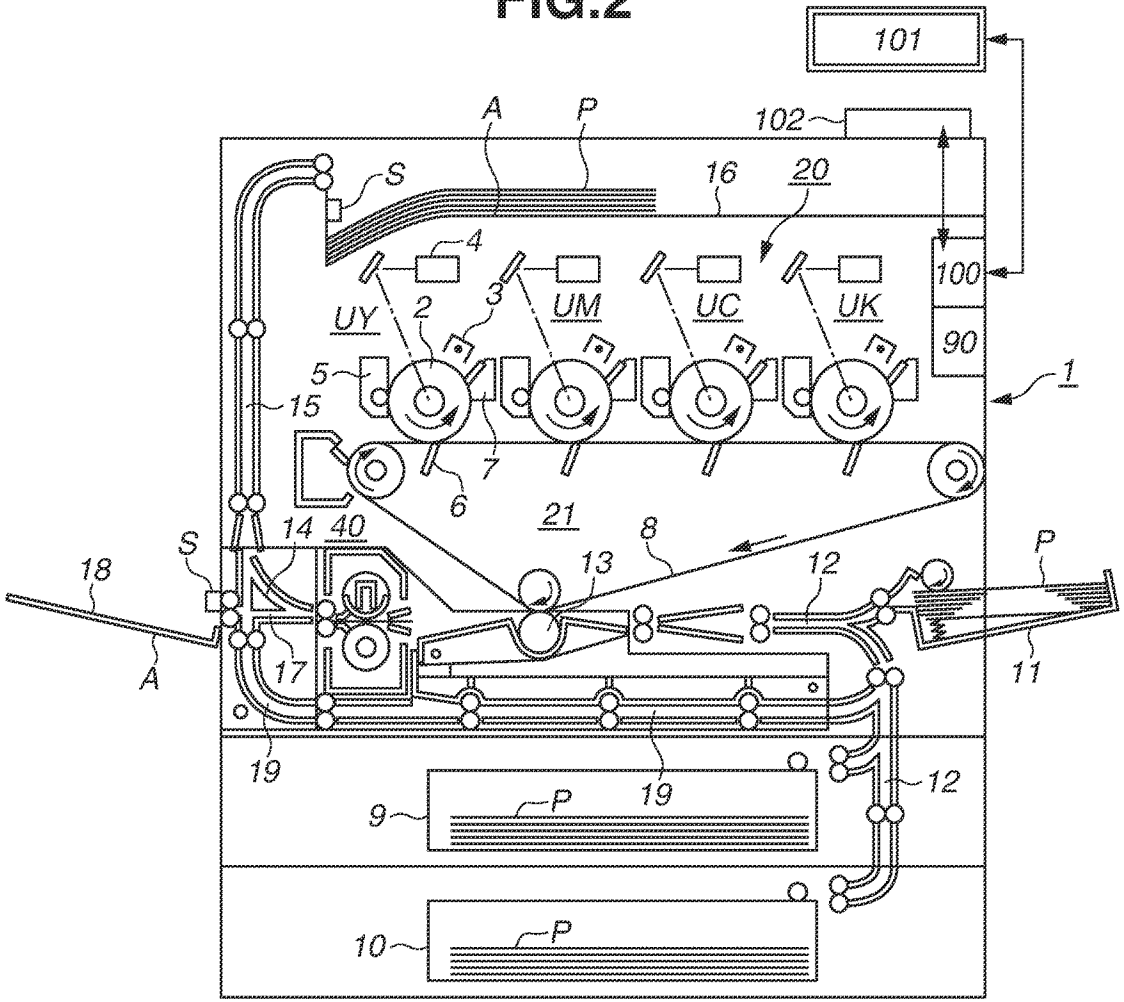
FIG. 2 is a sectional view schematically illustrating an example of an image forming apparatus.

FIG. 2 is a schematic sectional view illustrating an image forming apparatus 1 according to an embodiment of the present disclosure. The image forming apparatus 1 is a full-color laser printer (digital printer; hereinafter referred to as a printer) which employs a tandem system and an intermediate transfer system. The printer 1 performs an image forming operation (print operation) corresponding to a print job input to a controller unit 100 from an external data transmission device (hereinafter referred to as a network unit) 101 such as a computer. An image-formed matter obtained by forming a full-color or monochrome toner image on each recording sheet (recording material) P by the image forming operation is output from the printer.

The term "print job" refers to an image forming instruction to which image data, information about the type of a recording sheet to be used or the like, and print condition information indicating the number of sheets, the number of copies, post-processing, and the like are added. The recording sheet P is a sheet-like recording medium on which a toner image (developer image) can be formed by a printer (image forming apparatus). Examples of the recording sheet P include plain paper, a resin sheet, glossy paper, a postcard, an envelope, and a label. The recording sheet P is hereinafter referred to as a sheet or paper.

An operation unit 102 is a user interface unit used by an operator (user) to input (set or register) various information to a control circuit unit 90 through the controller unit 100. Upon receiving a print job from the network unit 101, the controller unit 100 forms an image signal for image formation from image data and transmits the image signal to the control circuit unit 90. Based on the image signal, the control circuit unit 90 causes an image forming mechanism unit (image forming unit) to execute an image forming operation for forming an unfixed toner image on the recording sheet P.

The image forming mechanism unit 20 that forms an unfixed toner image on each recording sheet P includes four image forming units U (Y, M, C, and K) which form four toner images of yellow (Y), magenta (M), and cyan (C), which are three primary colors of a subtractive color mixture, and black (K), respectively. The image forming mechanism unit 20 further includes a transfer unit 21 including an endless intermediate transfer belt 8.

Each image forming unit U includes a photosensitive drum 2, a charger 3, a laser scanner 4, a developing device 5, a primary transfer charger 6, and a drum cleaner 7. In order to avoid complication of the figure, illustration of reference numerals denoting the constituent elements in the image forming units UM, UC, and UK other than the image forming unit UY is omitted. Further, an electrophotographic process and an image forming operation of each of the image forming units U generally are known, and thus the descriptions thereof are omitted.

The respective color toner images are primarily transferred, in a superposed manner, from the drum 2 of each image forming unit U onto the turning intermediate transfer belt 8 in a predetermined manner. As a result, four-color superposed color toner images are formed on the belt 8. On the other hand, a single recording sheet P is fed from a sheet feed cassette 9 or 10 or a manual feed tray 11 and is conveyed through a conveyance path 12, and is then introduced into a secondary transfer nip portion, which is a pressure contact portion between the belt 8 and a secondary transfer roller 13, at a predetermined timing. As a result, the four-color superimposed toner images formed on the belt 8 are secondarily transferred altogether onto the recording sheet P. The recording sheet P is introduced into a fixing device 40 (fixing unit) where the toner images are subjected to a heat fixing process.

In a one-sided image forming mode, the recording sheet P which has come out of the fixing device 40 is guided toward a conveyance path 15 under control by a flapper 14 and is then discharged as a full-color image-formed matter onto a sheet discharge tray (FD tray) 16 with its face down. Alternatively, the recording sheet P is guided toward a conveyance path 17 and is then discharged onto a discharge tray (FU tray) 18 with its face up (FU discharge).

In a double-sided image forming mode, the recording sheet P with an image formed on one side thereof that has come out of the fixing device 40 is guided toward the conveyance path 15 once under control of the flapper 14. After that, the recording sheet P is conveyed in a switch-back manner and is then introduced to a duplex conveying path 19. In a state where the recording sheet P is turned upside down, the recording sheet P passes through the conveyance path 12 again and is introduced into the secondary transfer nip portion where the toner images are formed on the other surface of the recording sheet P. After that, like in the case of the one-sided image forming mode, the recording sheet P is introduced into the fixing device 40 and is then discharged as a double-sided image-formed matter onto the discharge tray 16 or 18.

In a monochrome image forming mode, out of the four image forming units U described above, the image forming unit that is required to form the monochrome image executes image formation, and the photosensitive drum 2 in each of the image forming units that are not required in this case is idly rotated.

In the present embodiment, each of the sheet discharge trays 16 and 18 is a sheet discharge unit capable of stacking a plurality of sheets that have passed through the fixing device 40 and have been discharged.

<Fixing Device>

Figure 3:
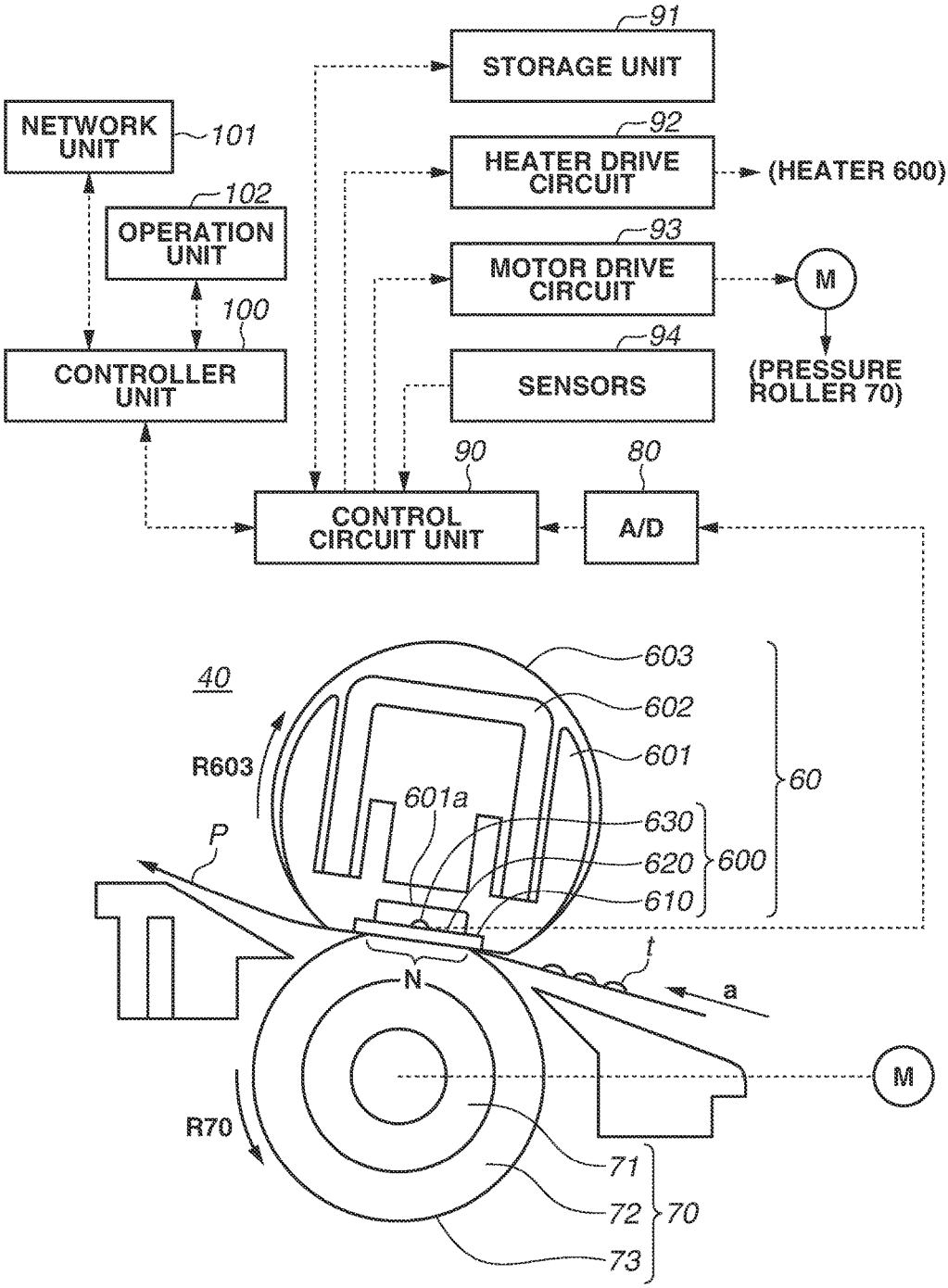
FIG. 3 illustrates a schematic cross-sectional view of a mounted fixing device and a block diagram of a control system.
Figure 4:
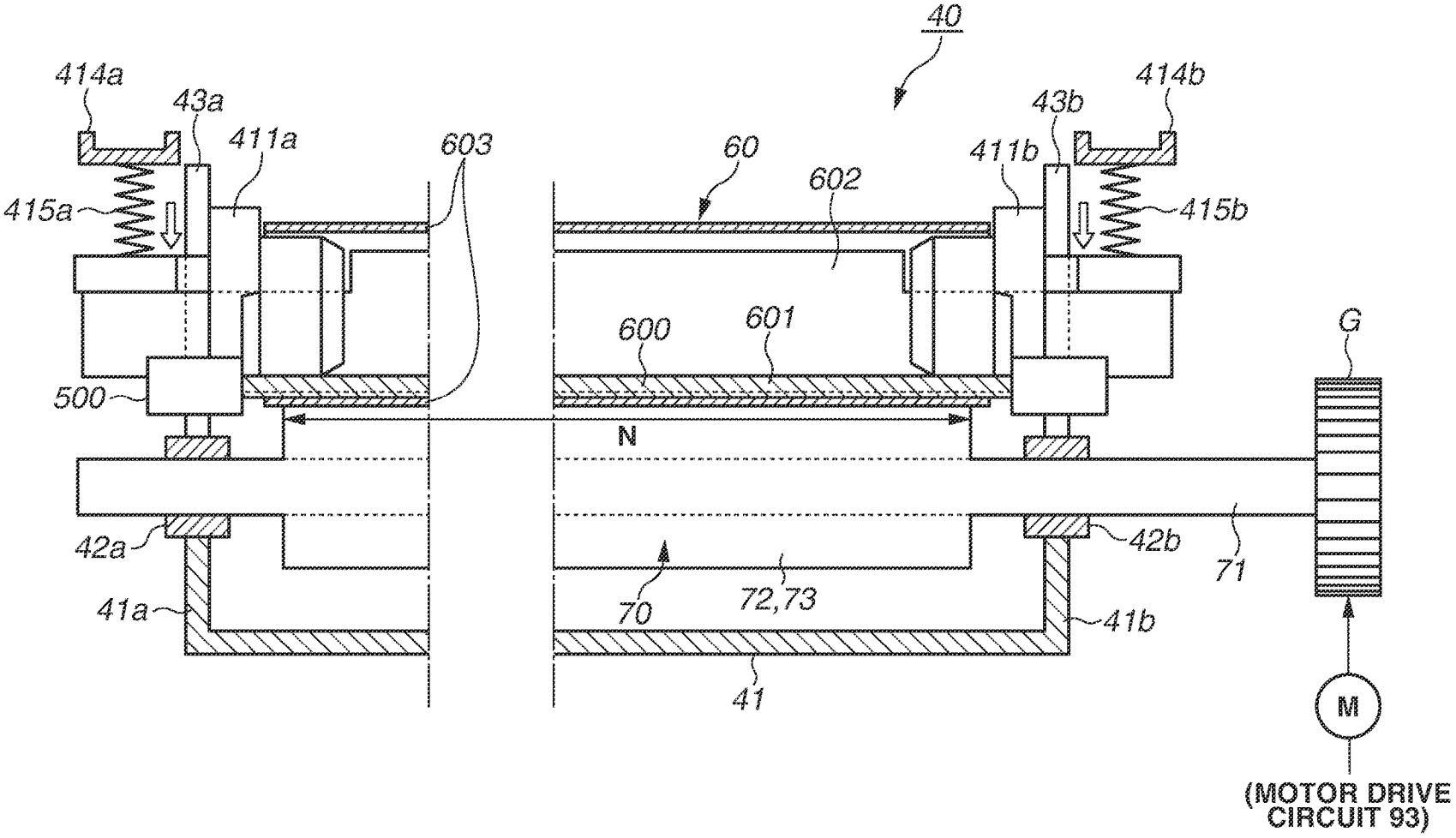
FIG. 4 is a sectional longitudinal sectional view illustrating the fixing device.

Next, the fixing device 40 according to the present embodiment will be described. FIG. 3 illustrates a cross-sectional view schematically illustrating a major part of the fixing device 40 and a block diagram of a control system. FIG. 4 is a sectional longitudinal sectional view illustrating the fixing device 40, in which the illustration of a middle portion of a major part of the fixing device 50 is omitted. The front surface of the fixing device 40 is a surface viewed from a side where a sheet is introduced.

The fixing device 40 is an image heating device of a heating belt type, and includes a belt unit (film unit) 60, an elastic pressure roller 70, and a device casing 41 that accommodates these components arranged substantially in parallel.

The belt unit 60 includes a heater (heating body or heating unit) 600 that functions as a nip forming member, a heater holder 601 that supports the heater 600 in a fixed manner, and a support tray 602 that supports the heater holder 601. Further, the belt unit 60 includes an endless belt-like (cylindrical; a hollow body) flexible thin fixing belt (first rotary member; hereinafter referred to as a belt) 603 as a heat-conductive member, which is a loosely fitted around an assembly of these members. The belt 603 is rotatable while the inner surface thereof is sliding with respect to the heater 60 in contact therewith.

In the present embodiment, the pressure roller (second rotary member) 70 is a rotary driving member for forming a nip portion N to heat a toner image t on a sheet in cooperation with the belt (first rotary member) 603 and for rotating the belt 603. The pressure roller 70 has an elastic layer 72 formed coaxially around a core metal 71 in a roller shape, and further has a releasable layer 73 formed as a surface layer. Both end portions of the core metal 71 of the pressure roller 70 are rotatably held between side plates 41*a* and 41*b* via bearings 42 *a* and 42*b*, respectively, at one end side and the other end side of the device casing 41 in the longitudinal direction thereof.

The pressure roller 70 contacts the heater 600 of the belt unit 60 through the belt 603 against elasticity of the elastic layer 72 and forms the nip portion (fixing nip portion) N for nipping and conveying, and heating the recording sheet P bearing an unfixed toner image t between the pressure roller 70 and the belt 603.

In the fixing device 40 according to the present embodiment, the heater 600 presses the belt 603 toward the pressure roller 70 so that the nip portion N has a predetermined width in a sheet conveyance direction (recording material conveyance direction) "a". In a process in which the recording sheet P is nipped and conveyed through the nip portion N, heat generated by the heater 600 is imparted to the recording sheet P through the belt 603, so that the unfixed toner image t formed on the recording sheet P is heated and fixed to thereby obtain a fixed image under application of heat and pressure.

In the present embodiment, the heater 600 is a so-called ceramic heater. The heater 600 is a heat generating member which includes, as a basic structural body, a ceramic substrate 610 and a resistance heating element (a resistance heating layer; hereinafter referred to as a heating element) 620 provided on the substrate 610 and generates heat by electric power supply. The heater 600 further includes a thermistor (TH) 630 which is a temperature sensor (temperature detection unit) for detecting the temperature of the heater 600. The heater 600 is fit into a recessed portion 601*a*, which is provided on a under surface of the heater holder 601 so as to extend along the longitudinal direction of the heater holder 601, and is supported in a fixed manner.

In the present embodiment, the heat generating member 620 is provided at a back surface side (a side where the substrate 610 does not contact the belt 603) of the substrate 610. The thermistor 630 is provided on the back surface side of the heater 600. However, the present disclosure is not limited thereto. The heat generating member 620 may be provided on a front surface side (a side where the substrate 610 contacts the belt 603) of the substrate 610.

The heater holder (hereinafter referred to as the holder) 601 is a member for holding the heater 600 in a state of pressing the heater 600 toward the belt 603. The holder 601 has a substantially half-round cross-sectional shape and has a function for regulating the rotational trajectory of the belt 603. A heat-resistant resin material is used for the holder 601.

The support stay (hereinafter referred to as the stay) 602 is member for supporting the heater 600 through the holder 601. The stay 602 is preferably made of a material which is not easily deformed even when a large load is applied thereto. In the present embodiment, SUS 304 (stainless steel) is used for the stay 602.

As illustrated in FIG. 4, the stay 602 is supported by flanges 411*a* and 411*b* at the both end portions in the longitudinal direction thereof. The flanges 411*a* and 411*b* are collectively referred to as the flanges 411. The flanges 411 regulate the movement of the belt 603 in the longitudinal direction thereof and the circumferential shape of the belt 603. In the present embodiment, a heat-resistant resin material or the like is used for the flanges 411.

Flanges 411 (a and b) engage with guide slits 43*a* and 43*b*, which are provided on side plates 41*a* and 41*b* on one end side and the other end side, respectively, of the device casing 41, and thus have a degree of freedom of sliding (moving) in directions toward and away from the pressing roller 70. Between the flanges 411 (a and b) and pressing arms 414*a* and 414*b*, pressure springs 415*a* and 415*b* are provided in a compressed state.

With the structure described above, an elastic force of each of the urging springs 415*a* and 415*b* is transmitted to the heater 600 through the flange 411, the stay 602, and the holder 601. Further, the belt 603 is pressed with a predetermined pressing force toward the pressure roller 70 by the heater 600 or by the heater 600 and the holder 601 against elasticity of the elastic layer 72 of the pressure roller 70. As a result, the nip portion N having a predetermined width in the sheet conveyance direction "a" is formed between the belt 603 and the pressure roller 70. In the present embodiment, the pressure force at each of the one end side and the other end side is about 156.8 N, and the total pressure force is about 313.6 N (32 kgf).

An electric connector 500 is a power feeding member electrically connected to the heater 600 for applying a voltage to the heater 600. The connector 500 is detachably attached to one longitudinal end side of the heater 600.

A gear G is provided at one end of the core metal of the pressure roller 70 and transmits a rotational driving force of a motor (drive unit) M to the pressure roller 70. The motor M is driven by a motor drive circuit 93 controlled by the control circuit unit 90. The pressure roller 70 driven by the motor M is rotated in a direction indicated by an arrow R70 illustrated in FIG. 3 and transmits the driving force to the belt 603 at the nip portion N, so that the belt 603 is rotated in a direction indicated by an arrow R603 by rotational driving of the pressure roller 70. In the present embodiment, the motor drive circuit 93 is controlled by the control circuit unit 90 so that the surface velocity of the pressure roller 70 is 200 mm/sec.

<Control Unit of Fixing Device>

As described below, the control circuit unit 90 is a circuit including a central processing unit (CPU) for performing calculations required for various controls, and a storage unit including a non-volatile medium or a volatile medium, such as a random access memory (RAM) or a read only memory (ROM). Various programs and reference tables are stored in the ROM, and the CPU loads the programs and tables to execute various control operations.

Electric power is supplied to the heater 600 from a heater drive circuit (power supply) 92, which is controlled by the control circuit unit 90, via the connector 500. By this electric power supply, the heat generating member 620 of the heater 600 generates heat, so that an effective heat generation width region of the heater 600 sharply increases. Then, the temperature of the heater 600 is detected by the thermistor 630, and an output depending on detected temperature information is transmitted to the control circuit unit 90 through an A/D converter 80.

The control circuit unit 90 reflects the temperature information acquired from the thermistor 630 to the electric power supply control of the heater drive circuit 92 and controls the electric power to be supplied to the heater 600. In the present embodiment, a method in which the control circuit unit 90 performs a wave number control or a phase control on the output of the heater drive circuit 92 to adjust the amount of heat generation of the heater 600 is used. Accordingly, when a toner image is fixed onto a sheet, the temperature of the heater 600 is increased and maintained at a predetermined temperature (temperature control).

As described above, the pressure roller 70 is rotationally driven by the driving force of the motor M. With this rotational driving, the belt 603 is rotated while the inner surface of the belt 603 is sliding in close contact with the surface of the heater 600 or with the surface of the heater 600 and a part of an outer surface of the holder 601. Further, the electric power supply to the heater 600 is controlled, and the temperature of a heat generation region of the heater 600 is increased to a predetermined temperature and thus the heater 600 is temperature-controlled.

In this apparatus state, the recording sheet P bearing the unfixed toner image t is introduced to the fixing device 40 from the image forming mechanism unit 20, and enters the nip portion N where the recording sheet P is nipped and conveyed. As a result, at the nip portion N, the toner image is fixed onto the recording sheet P under application of heat and pressure. The recording sheet P which has passed through the nip portion N is curvature-separated from the surface of the belt 603 and is discharged and conveyed.

<Maximum Toner Application Amount>

Figure 5:
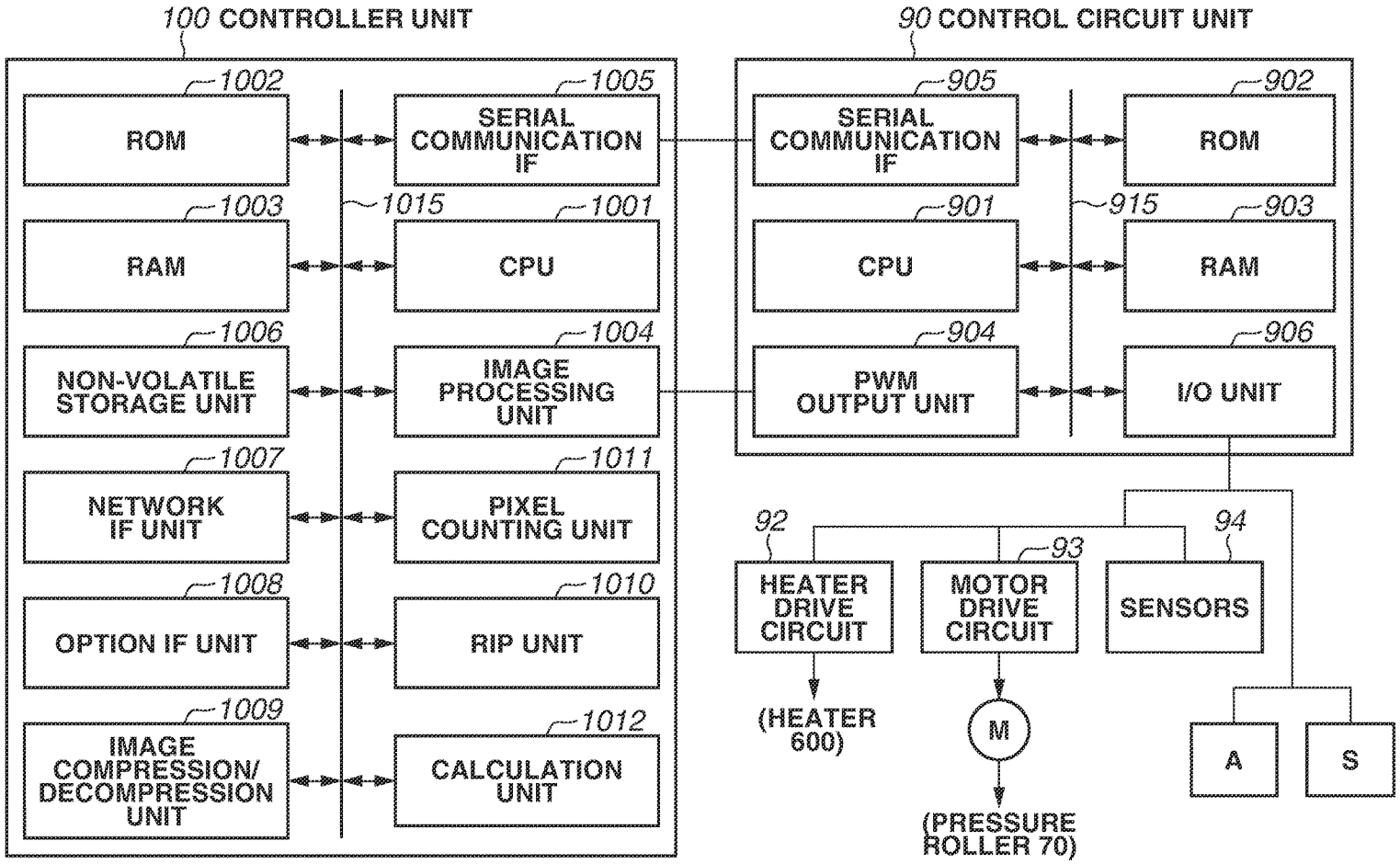
FIG. 5 is a block diagram illustrating a controller unit and a control circuit unit.

FIG. 5 is a block diagram illustrating the controller unit 100 and the control circuit unit 90. The controller unit 100 functions as a video controller unit, and the control circuit unit 90 functions as an engine controller unit.

The controller unit 100 includes a CPU bus 1015. The controller unit 100 also includes various devices 1001 to 1012 which are connected to each other via the CPU bus 1015. The CPU bus 1015 includes address, data, and control buses.

Specifically, the various devices 1001 to 1012 are the CPU 1001, the ROM 1002, the RAM 1003, the image processing unit 1004, the serial communication IF 1005, the non-volatile storage unit 1006, the network IF unit 1007, the option IF unit 1008, the image compression/decompression unit 1009, the RIP unit 1010, the pixel counting unit 1011, and the calculation unit 1012.

The control circuit unit 90 includes a CPU bus 915. The control circuit unit 90 also includes various devices 901 to 906 which are connected to each other via the CPU bus 915. The CPU bus 915 includes address, data, and control buses. Specifically, the various devices 901 to 906 are the CPU 901, the ROM 902, the RAM 903, the pulse width modulation (PWM) output unit 904, the serial communication IF 905, and the input/output (I/O) unit 906.

In the controller unit 100, the CPU 1001 is a central processing unit (CPU) that provides instructions to each unit constituting the controller unit 100. The ROM 1002 is a boot read only memory (ROM) that stores a boot program. The non-volatile storage unit 1006 is a hard disk drive that stores control programs for the controller unit 100, input image data, and the like. The RAM 1003 is a random access memory that stores work data for control programs for the controller unit 100.

The network IF unit 1007 is a local area network (LAN) card for delivering image data to and from a computer in the network unit 101. The option IF unit 1008 is an interface for delivering image data to and from a document image reading device or a facsimile (FAX) line in the network unit 101. The option IF unit 1008 includes a lattice connector to be connected to the document image reading device, and a modem to be connected to a public line. Assume that the resolution of the image data according to the present embodiment is 1200 dpi.

The image data input from the network unit 101 through the network IF unit 1007 or the option IF unit 1008 is compressed by the image compression/decompression unit 1009 and the compressed image data is stored in the non-volatile storage unit 1006.

In this case, when the image data is a page description language (PDL) data input through the network IF unit 1007, the compression processing is performed as follows. Specifically, in the RIP unit 1010 serving as a raster image processor, the compression processing is performed after the PDL code is developed into raster image data.

The image processing unit 1004 performs image processing depending on the characteristics of the printer (image forming apparatus) 1 on the input image data. The pixel counting unit 1011 integrates density values of pixels constituting the image data of each color for each of the color components Y, M, C, and K on the input image data (the value thus obtained is hereinafter referred to as a pixel value). In the present embodiment, the density value of each pixel has an 8-bit (0 to 255) gradation. For example, when the density value of a first pixel of Y image data is 100 and the density value of a second pixel is 50, the sum of the pixel values of the first and second pixels is 150.

The integration of pixel values as described above is carried out on all color components of all pixels within a predetermined region. More specifically, the pixel counting unit 1011 acquires print information (image value) about the unfixed toner image formed by the image forming mechanism unit 20. The pixel value calculated by the pixel counting unit 1011 is stored in a register (not illustrated) within the pixel counting unit 1011. After counting the number of pixels in a prescribed region, the pixel counting unit 1011 sends an interrupt signal to the CPU 1001.

In the controller unit 100, the CPU 1001 reads the register based on the control program using the interrupt signal as a trigger, thereby making it possible to acquire the pixel value at that time. Further, based on the pixel value acquired by the pixel counting unit 1011, the calculation unit 1012 calculates a highest pixel value within a sheet surface, i.e., a maximum toner application amount per unit area of a toner image formed on a sheet. In the present embodiment, the calculation unit 1012 is an application amount acquisition unit (acquisition unit; first acquisition unit) that acquires information about a maximum toner application amount within a sheet surface (within a recording material surface) during a print operation.

The controller unit 100 reads the image data stored in the non-volatile storage unit 1006 in synchronization with the operation of the printer (image forming apparatus) 1 in accordance with an instruction from the CPU 1001 based on a control program and causes the compression/decompression unit 1009 to perform decompression of the data. After the image processing performed by the image processing unit 1004 and the pixel counting performed by the pixel counting unit 1011, an image signal is sent to the PWM output unit 904 of the control circuit unit 90.

In the control circuit unit 90, the CPU 901 is a central processing unit (CPU) that provides instructions to each unit constituting the control circuit unit 90. The ROM 902 is a read only memory (ROM) that stores firmware as a control program. The RAM 903 is a random access memory (RAM) that stores work data for control programs for the control circuit unit 90.

The PWM output unit 904 is connected to the image processing unit 1004 of the controller unit 100, and generates a pulse width modulation (PWM) signal based on the image signal sent from the image processing unit 1004.

The I/O unit 906 is connected to various actuators and sensors (not illustrated) included in the printer 1. In the control circuit unit 90, each unit of the printer 1 is driven to perform printing by an electrophotographic process in accordance with an instruction from the CPU 901 based on a control program. The heater drive circuit 92, the motor drive circuit 93, and sensors 94 for actuating the fixing device 40 are also connected to the I/O unit 906.

A sheet discharge tray temperature detection sensor A (a temperature detection unit of the sheet discharge unit) and a sheet bundle stacking amount detection sensor S (a recording sheet stacking amount detection unit of the sheet discharge unit), which are included in each of the FD tray 16 and the FU tray 18, and are described below, are also connected to the I/O unit 906.

In the present embodiment, each of the sensor A and the sensor S is a sheet bundle information acquisition unit (a second acquisition unit that acquires the number of recording materials stacked on the sheet discharge unit) that acquires stacked sheet bundle information (recording sheet bundle information) about sheets stacked and accommodated on the FD tray 16 and the FU tray 18, each of which is the sheet discharge unit.

The controller unit 100 and the control circuit unit 90 include the serial communication IFs 1005 and 905, respectively, of a three-wire system, and the CPU 1001 and the CPU 901 transmit and receive data via the serial communication IFs 1005 and 905, respectively.

Information about a print job, such as detailed information (described below) mainly about the size and resolution of input image data and a sheet to be used, and a pixel value, is sent from the controller unit 100 to the control circuit unit 90. Further, a highest pixel value (maximum toner application amount information) within a sheet surface, which is calculated by the calculation unit 1012, is sent from the controller unit 100 to the control circuit unit 90. The control circuit unit 90 controls the throughput (the number of image formations on sheets per unit time; the number of sheets formed the toner images per unit time) of the printer 1 based on the received information.

<Throughput Control>

Figure 6:
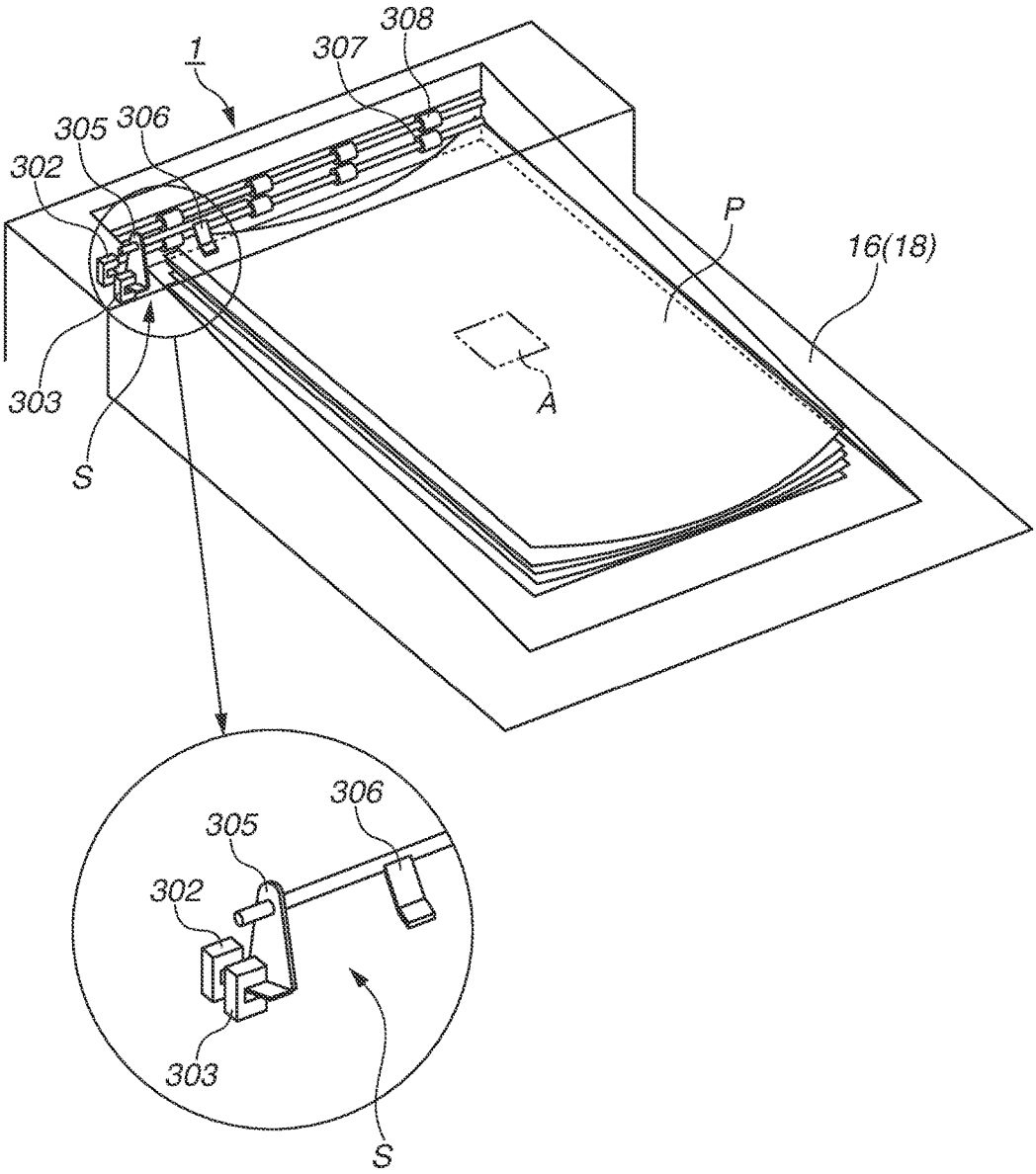
FIG. 6 is a configuration diagram illustrating a sheet bundle stacking amount detection sensor.

Next, a throughput control for preventing adhesion between sheets (between recording materials) discharged and stacked onto the sheet discharge tray will be described with reference to FIGS. 2, 3, and 6.

As illustrated in FIG. 2, in the printer 1, the sheet discharge tray temperature detection sensor A is provided on each of the FD tray 16 and the FU tray 18, which are two sheet discharge units. The sensor A is a contact-type temperature sensor that acquires a sheet bundle bottom temperature (a bottom temperature of stacked recording sheets) T of recording sheets P stacked on each tray. The temperature information detected by the sensor A is input from the I/O unit 905 to the control circuit unit 90.

In the vicinity of a sheet discharge port for each of the FD tray 16 and the FU tray 18, the sheet bundle stacking amount detection sensor (detection unit) S that acquires the stacking amount of sheet bundles on each tray (the number of stacked recording sheets) is provided. FIG. 6 illustrates a configuration example of the sensor S provided on the FD tray 16. Since the sensor S provided on the FU tray 18 has a configuration similar to the configuration of the sensor S provided on the FD tray 16, a configuration example of the sensor S provided on the FD tray 16 will be described as a representative example.

The sensor S includes a contact-type lever 306, a sensor flag 305, and photo-interrupters 302 and 303 to detect the sheet bundle stacking amount H of recording sheets P on the sheet discharge tray 16 (18). Each recording sheet P is discharged onto the tray 16 (18) by sheet discharge roller rows 307 and 308. The contact-type lever 306 is rotated according to the stacking amount of recording sheets P on the tray 16 (18), thereby rotating the sensor flag 305. The control circuit unit 90 reads the amount of rotation of the sensor flag 305 from flag state information from the photo-interrupters 302 and 303 that is input from the I/O unit 905, thereby detecting the sheet bundle stacking amount H on the tray 16 (18).

Further, the control circuit unit 90 performs a throughput control. In the throughput control according to the present embodiment, a conveyance interval (sheet-to-sheet interval) of recording sheets P each having an image formed thereon is controlled to thereby control the number of prints (number of image formations) per given time (per unit time).

The controller unit 100 receives image data from the network unit 101 of an external computer, a document image reading device, or a FAX line, and rasterizes print image while checking a request from the operation unit 102. The control circuit unit 90 controls the storage unit 91, the heater drive circuit 92, the motor drive circuit 93, and the sensors 94, to thereby control the fixing device 40, and performs fixing processing on the unfixed toner image t.

In a first embodiment, a configuration for controlling a throughput based on the stacking number of recording sheets stacked on the sheet discharge unit and the maximum toner application amount within a sheet surface having an image formed thereon will be described. In a case where an image is formed with a small maximum toner application amount in a state where a certain number of recording materials are stacked on the sheet discharge unit, the sheets are conveyed at a normal throughput so as to prevent a deterioration in productivity. In a case where an image is formed with a large maximum toner application amount in a state where a certain number of recording materials are stacked on the sheet discharge unit, the throughput is set to be lower than the normal throughput so as to prevent adhesion between sheets to be discharged. A control example according to the first embodiment will be described in more specifically below.

The FD sheet discharge tray 16 and the FU sheet discharge tray 18 are hereinafter referred to collectively as a sheet discharge tray.

In the first embodiment, the control circuit unit acquires, as the stacked sheet bundle information (bundle information) on the sheet discharge tray, the sheet bundle bottom temperature T by the temperature sensor A, and the sheet bundle stacking amount H by the sheet bundle stacking amount detection sensor S. An allowable maximum application amount F(th=T×H: allowable application amount) of toner on the recording sheet on which an image is to be formed is calculated (acquired) based on these pieces of information. The allowable maximum application amount F(th) is compared with the maximum application amount M of toner within a sheet surface (within a recording material surface) acquired during image formation.

If the maximum application amount M exceeds the calculated allowable maximum application amount F(th), the throughput for the recording material is reduced. As the throughput is reduced, a time required for the subsequent sheet to be discharged and stacked on the sheet already discharged onto the sheet discharge tray increases. In other words, a time required for cooling the sheet to be stacked on the sheet discharge tray can be secured sufficiently, thereby preventing adhesion between sheets to be discharged.

Next, a method for calculating the allowable maximum application amount F(th) of toner will be described with reference to FIG. 7. The adhesion between sheets on the sheet discharge tray is more likely to occur as the sheet bundle bottom temperature T on the sheet discharge tray increases, and as the sheet bundle stacking amount H on the sheet discharge tray increases and a load applied to the sheets in the sheet bundle increases. Further, the adhesion is more likely to occur as the toner application amounts on stacked sheets increases.

Figure 7:
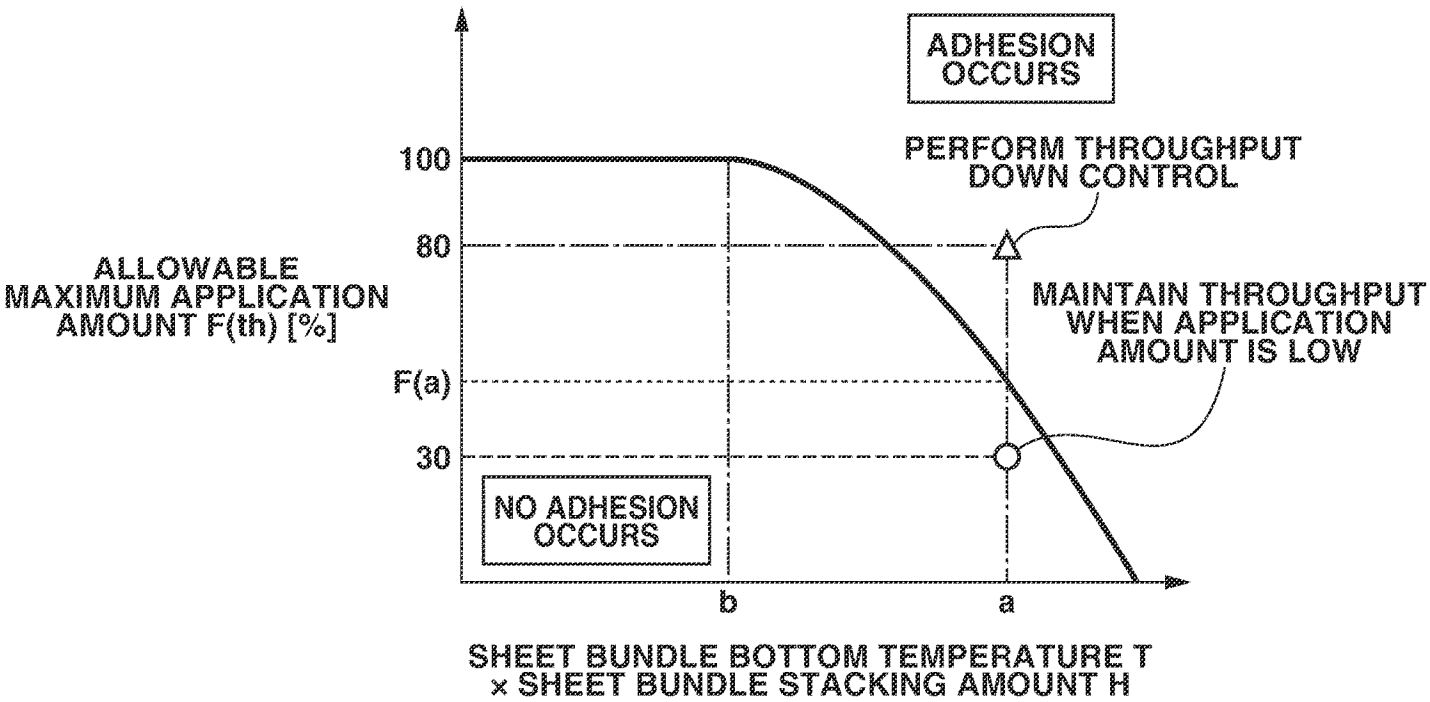
FIG. 7 is a graph illustrating a relationship between a sheet bundle bottom temperature T, a sheet bundle stacking amount H, and an allowable maximum application amount F(th) of toner.

In view of the above, the relationship between the sheet bundle bottom temperature T, the sheet bundle stacking amount H, and the allowable maximum application amount F(th) of toner on sheets when the adhesion between sheets occurs can be represented by FIG. 7. In the present embodiment, the control circuit unit 90 acquires the sheet bundle bottom temperature T and the sheet bundle stacking amount H, thereby calculating the allowable maximum application amount F(th) illustrated in FIG. 7. More specifically, the control circuit unit 90 acquires the sheet bundle bottom temperature T and the sheet bundle stacking amount H respectively from the sensors A and S, which are provided on the sheet discharge tray, and also acquires the allowable maximum application amount F(th) illustrated in FIG. 7 from a correlation table, preliminarily stored in the RAM 903, indicating the correlation between the sheet bundle bottom temperature T, the sheet bundle stacking amount H, and the allowable maximum application amount.

Figure 1:
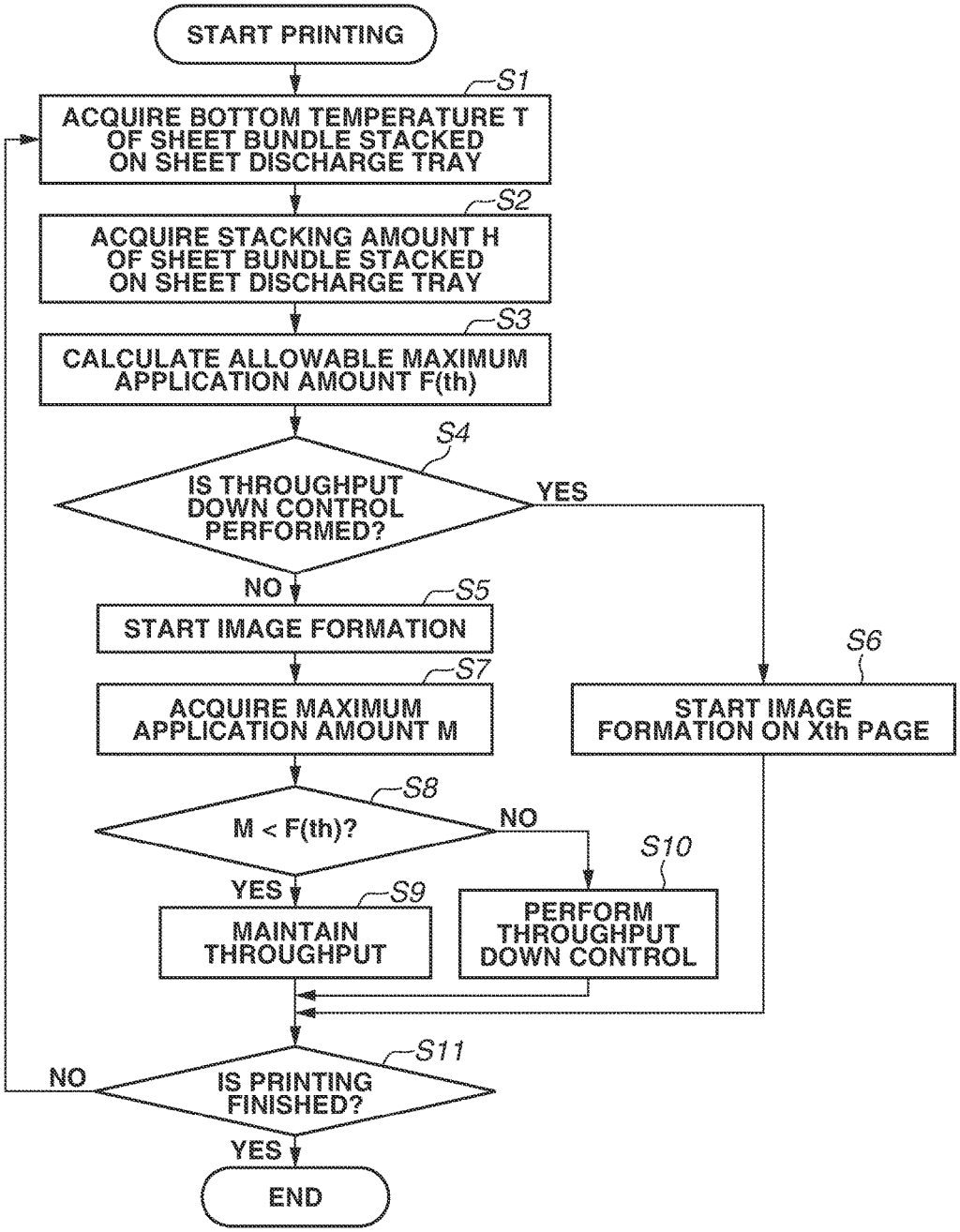
FIG. 1 illustrates a flowchart for throughput control according to a first embodiment.

Next, the throughput control according to the first embodiment will be described with reference to a flowchart illustrated in FIG. 1. This throughput control is performed by the control circuit unit 90 illustrated in FIG. 5.

When printing is started, in step S1, the control circuit unit 90 acquires the sheet bundle bottom temperature T on the sheet discharge tray through the temperature detection sensor A, and then the processing proceeds to step S2.

In step S2, the control circuit unit 90 acquires the sheet bundle stacking amount H on the sheet discharge tray through the sheet bundle stacking amount detection sensor S, and then the processing proceeds to step S3.

In step S3, the control circuit unit 90 calculates the allowable maximum application amount F(th) based on the sheet bundle bottom temperature T obtained in step S1 and the sheet bundle stacking amount H obtained in step S2, and then the processing proceeds to step S4.

In step S4, the control circuit unit 90 determines whether the throughput down control is performed. If the control circuit unit 90 determines that the throughput down control is not being performed (NO in step S4), the processing proceeds to step S5. If the control circuit unit 90 determines that the throughput down control is being performed (YES in step S4), the processing proceeds to step S6.

In step S5, the control circuit unit 90 start image formation, and then the processing proceeds to step S7.

In step S6, image formation is started, and then the processing proceeds to step S11.

In step S7, the control circuit unit 90 acquires the maximum application amount M, and in step S8, the control circuit unit 90 obtains the magnitude relationship between the maximum application amount M and the allowable maximum application amount F(th).

In step S8, if M<F(th) holds (YES in step S8), the processing proceeds to step S9. If M F(th) holds (NO in step S8), the processing proceeds to step S10.

In step S9, the control circuit unit 90 maintains the throughput (first throughput). In the present embodiment, the control operation is performed at a throughput of 50 sheets per minute, and then the processing proceeds to step S11.

In step S10, the control circuit unit 90 performs the throughput down control (for controlling the throughput to be changed from the first throughput to a second throughput that is lower than the first throughput by a predetermined level) to a throughput of 25 sheets per minute, and then the processing proceeds to step S11.

In step S11, if printing is finished (YES in step S11), the processing is terminated. If printing is not finished (NO in step S11), the processing returns to step S1.

The first embodiment described above is summarized as follows. The first acquisition unit 1012 that acquires the maximum toner application amount per unit area of a toner image formed on a recording sheet is provided. The second acquisition unit (stacked sheet bundle information acquisition unit) that acquires the number of recording sheets to be stacked on the sheet discharge units 16 and 18 is provided. The control circuit unit 90 that controls the number of image formations per unit time based on the information acquired by the first acquisition unit and the second acquisition unit is provided. The first acquisition unit corresponds to each of the temperature detection unit A that detects the temperature of the sheet discharge unit and the stacking amount detection unit S that detects the stacking amount of recording sheets on the sheet discharge unit.

When the above-described control operation is applied to a first image forming job for forming a toner image having a first amount as the maximum toner application amount per unit area on each of a plurality of recording sheets, and when the above-described control operation is applied to a second image forming job for forming a toner image having a second amount less than the first amount as the maximum toner application amount per unit area on each of a plurality of recording sheets, the following operation is carried out. In a case where the first image forming job is executed at the first throughput (the number of image formations per unit time is a first number of sheets, e.g., 50 sheets per minute), when the number of recording sheets stacked on the sheet discharge unit reaches a first stacking number of sheets, the control circuit unit 90 reduces the throughput in the first image forming job to the second throughput (e.g., 25 sheets per minute). On the other hand, in a case where the second image forming job is executed at the first throughput (e.g., 50 sheets per minute), when the sheet discharge unit is in the same state as that in the first image forming job (i.e., when the stacking number of sheets on the sheet discharge unit reaches the first stacking number of sheets), the control circuit unit 90 does not reduce the throughput in the second image forming job (e.g., the throughput of 50 sheets per minute is maintained).

Consequently, it is possible to provide an image forming apparatus that can prevent a deterioration in productivity, while preventing adhesion between recording sheets stacked on the sheet discharge unit.

Figure 8:
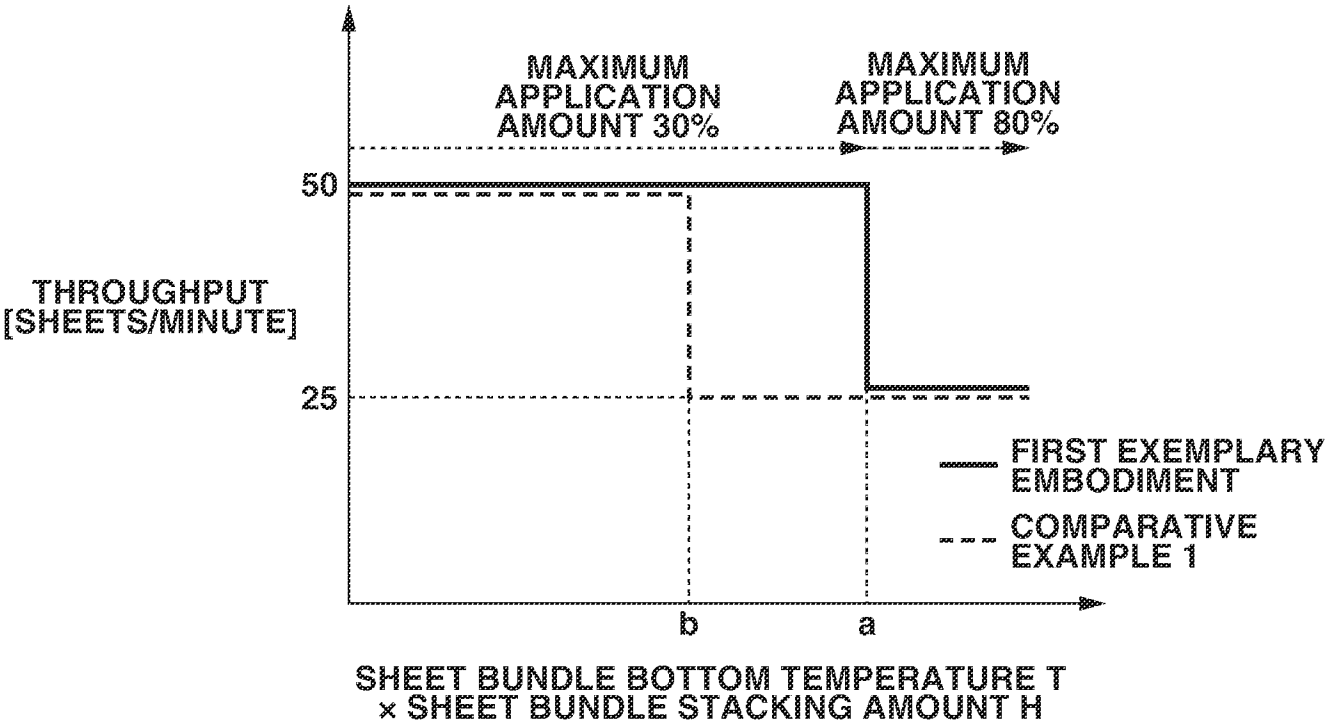
FIG. 8 is a graph illustrating a comparison between a first embodiment and Comparative Example 1.

Next, specific examples will be described with reference to FIGS. 7 and 8. Consider a case where (sheet bundle bottom temperature T)×(sheet bundle stacking amount H)="a" and the allowable maximum application amount F(th)=F(a) as illustrated in FIG. 7. In this case, when the maximum application amount M of toner on each sheet to be printed and discharged is 30%, there is no possibility of occurrence of adhesion between discharged sheets, and thus the throughput (first throughput) is maintained.

On the other hand, when the maximum application amount M of toner on each sheet to be printed and discharged is 80%, there is a possibility of occurrence of adhesion between sheets. Accordingly, an increase in the temperature of a sheet bundle stacked on the sheet discharge tray is suppressed by performing throughput down control (down to second throughput). Thus, the adhesion between sheets to be discharged onto the sheet discharge tray is prevented.

Further, the use of information about the maximum application amount M prevents an occurrence of an unnecessary throughput down control. To explain this beneficial effect by comparing the present embodiment with a comparative example of the related art, as illustrated in FIG. 8, image formation at the maximum application amount M of 30% on each sheet is performed until (sheet bundle bottom temperature T)×(sheet bundle stacking amount H) reaches "a" from the start of a print job. Further, consider a case where image formation at the maximum application amount M of 80% on each sheet is first performed at a timing when (sheet bundle bottom temperature T)×(sheet bundle stacking amount H) reaches "a".

In Comparative Example 1, if (sheet bundle bottom temperature T)×(sheet bundle stacking amount H) is set to be greater than "b" (i.e., F(th)<100) in FIG. 7 to reliably prevent an occurrence of adhesion between sheets to be discharged, there is a possibility of occurrence of adhesion between sheets to be discharged depending on the maximum application amount M of toner on each sheet. Accordingly, the throughput down control (from the first throughput to the second throughput) is immediately performed as indicated by a dashed line in FIG. 8.

However, if the maximum application amount F on the recording material is 30%, the adhesion between sheets to be discharged does not occur until (sheet bundle bottom temperature T)×(sheet bundle stacking amount H) reaches "a", so that an unnecessary throughput down control is carried out in Comparative Example 1, which is disadvantageous for users.

In the first embodiment, whether to execute the throughput down control is determined depending on the maximum application amount M of toner on each sheet. Accordingly, the throughput down control is carried out at a timing when the image formation at the maximum application amount M of 80% is performed as illustrated in FIG. 8, i.e., at a timing when M>F(a) holds. As a result, a productivity higher than that in Comparative Example 1 (related art) can be maintained for a longer period of time than in Comparative Example 1.

In a second embodiment, a configuration for performing a throughput control based on the number of recording sheets to be stacked on the sheet discharge unit and the maximum toner application amount within a sheet surface on which an image is to be formed will be described. Even in a case of stacking the same number of recording sheets on the sheet discharge unit, if the maximum toner application amount of a toner image to be formed on each sheet is small, the sheet is conveyed at the normal throughput to prevent a deterioration in productivity. In a case of stacking the same number of recording sheets on the sheet discharge unit, if the maximum toner application amount of a toner image to be formed on each sheet is large, the throughput is set to be lower than the normal throughput so as to prevent adhesion between sheets to be discharged. A control example according to the second embodiment will be described in more detail below.

In the second embodiment, the control circuit unit (estimation unit) 90 estimates the stacked sheet bundle information (bundle information; a sheet bundle internal temperature) on the sheet discharge tray during printing or after the end of printing from job reservation information (input print reservation information) obtained before image formation is started. Further, the control circuit unit (application amount acquisition unit) 90 calculates the allowable maximum application amount F(x) of toner. The allowable maximum application amount F(x) is compared with the maximum application amount M of toner within a sheet surface that is acquired during image formation (during the print operation). When the maximum application amount M exceeds the calculated allowable maximum application amount F(x), the throughput is reduced from the first throughput to the second throughput, thereby preventing adhesion between sheets to be discharged.

Figure 9:
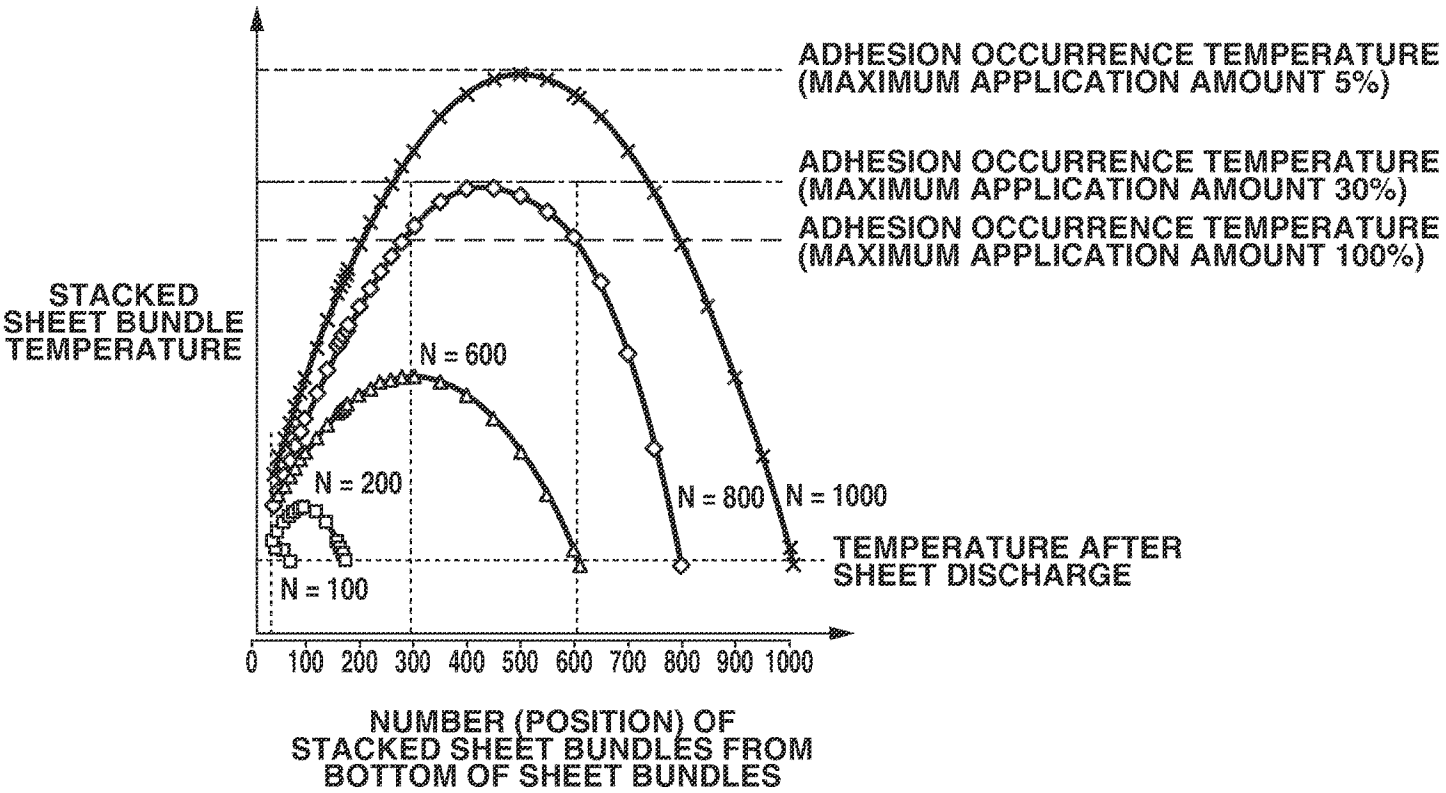
FIG. 9 is a graph illustrating a relationship between the number (position) of stacked sheet bundles from the bottom of the stacked sheet bundles and a stacked sheet bundle temperature at each number of stacked sheet bundles.
Figure 10:
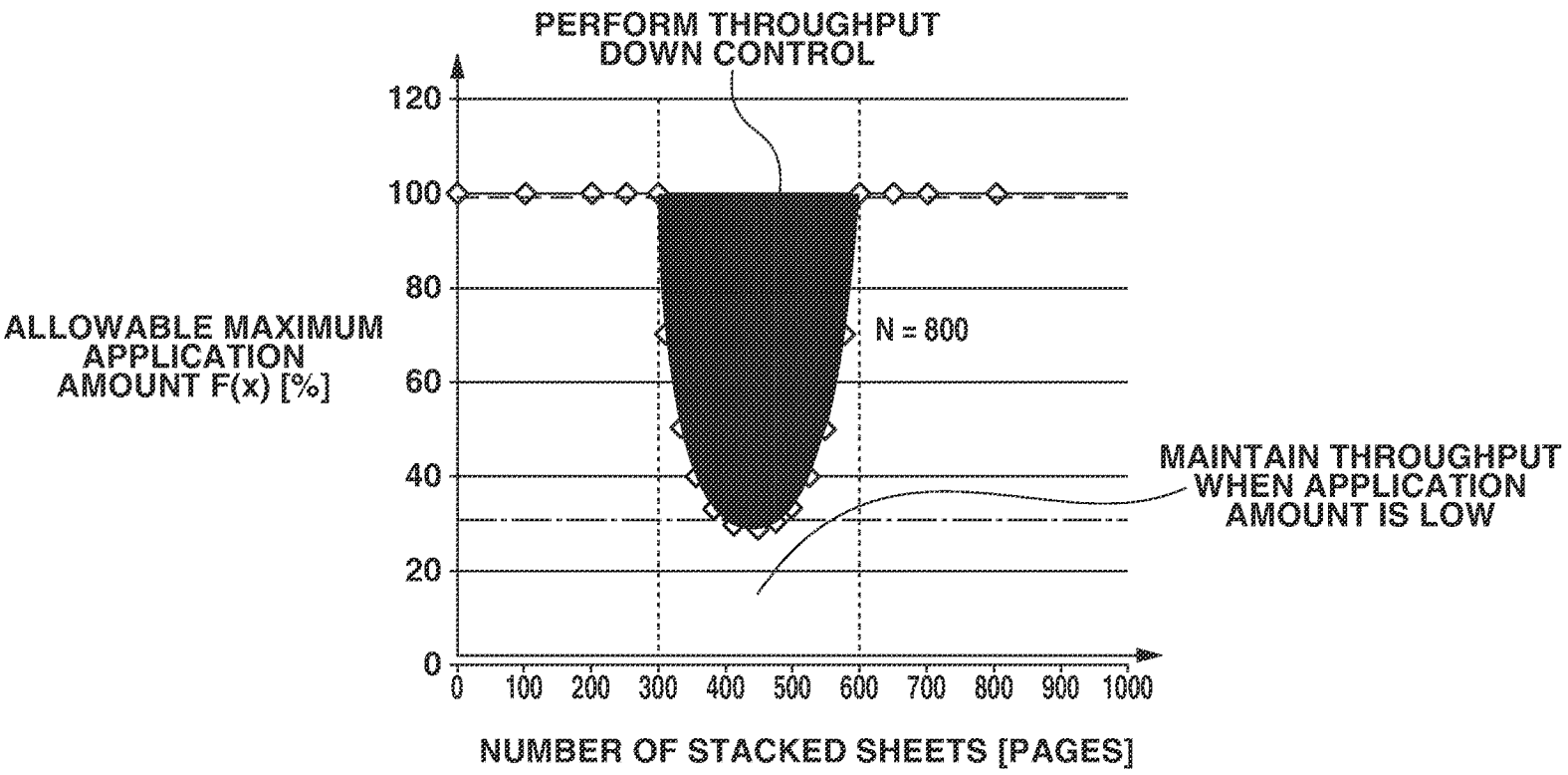
FIG. 10 is a graph illustrating a calculation result of an allowable maximum application amount F(x) at each number of stacked sheets when the total number of output sheets N=800.

Next, a method for calculating the allowable maximum application amount F(x) of toner will be described with reference to FIGS. 9 and 10. FIG. 9 illustrates a relationship between the number (position) of stacked sheet bundles from the bottom of the sheet bundles stacked on the sheet discharge tray and a stacked sheet bundle temperature at the number of stacked sheet bundles.

For example, when the print reservation information indicates that the total number of output sheets N=200, a bundle of 200 sheets is stacked on the sheet discharge tray after a series of print operations is finished. In this case, when the print operation is performed at a constant throughput, the sheet bundle internal temperature in the vicinity of a position corresponding to a 100th sheet from the bottom of the stacked sheet bundle becomes highest. This is because the subsequent sheets are sequentially discharged and stacked onto the sheets before the sheets already discharged onto the sheet discharge tray are sufficiently cooled, so that heat is stored in the sheet bundle.

Similarly, when the total number of output sheets N=600, 800, and 1000, the temperatures in the vicinity of positions corresponding to 300th, 400th, and 500th sheets from the bottom of the sheet bundle become highest.

On the other hand, the adhesion between sheets discharged and stacked on the sheet discharge tray is more likely to occur as the application amount of toner applied on each of the sheets increases, and thus the temperature at which the adhesion occurs can be roughly estimated from the maximum application amount of toner. Although not described herein, the adhesion occurrence temperature depends on the smoothness of a sheet surface and the like. This is because the surface property of toner on a sheet onto which toner is fixed varies depending on the smoothness of the surface of the sheet itself, so that the contact state between the toner and adjacent sheets changes and the fixing strength of the toner onto the sheet varies depending on the smoothness of the surface of the sheet itself.

In view of the above, the final reaching temperature at each position within a bundle of sheets to be stacked on the sheet discharge tray can be estimated by obtaining the total number of output sheets N of the job reservation information. Further, the allowable maximum application amount F(x) at which the adhesion between sheets does not occur can be calculated based on the relationship between the temperature at which the adhesion between sheets to be discharged occurs and the maximum application amount of toner.

For example, when the total number of output sheets N of the print reservation information is 800, a distribution of stacked sheet bundle temperatures after the end of the final printing operation is represented by a graph of FIG. 9 in which N=800. The allowable maximum application amount F(x) is calculated based on the graph, and a calculation result as illustrated in FIG. 10 is obtained.

In a case where the number of stacked sheets is in a range from 0 to 299, even when the sheets with a fixed image formed thereon are continuously stacked at the maximum application amount M of 100% on each sheet, the sheet bundle internal temperature is lower than the adhesion occurrence temperature, and thus the adhesion between sheets does not occur. Accordingly, the allowable maximum application amount F(x) is 100%.

In a case where the number of stacked sheets is in a range from 300 to 599, when the maximum application amount M on each sheet is high, the adhesion between sheets occurs. In this case, it is necessary to perform the throughput down control. Accordingly, the graph of FIG. 10 indicates that the allowable maximum application amount F(x) is less than 100%.

In a case where the number of stacked sheets is in a range from 600 to 800, like in the case where the number of stacked sheets is in the range from 0 to 299, even when the sheets with a fixed image formed thereon are continuously stacked at the maximum application amount M toner of 100%, the sheet bundle internal temperature is lower than the adhesion occurrence temperature, and thus the adhesion between sheets does not occur. Accordingly, the allowable maximum application amount F(x) is 100%.

In this manner, the allowable maximum application amount F(x) of toner is determined based on the stacked sheet bundle information estimated from the print reservation information.

Figure 11:
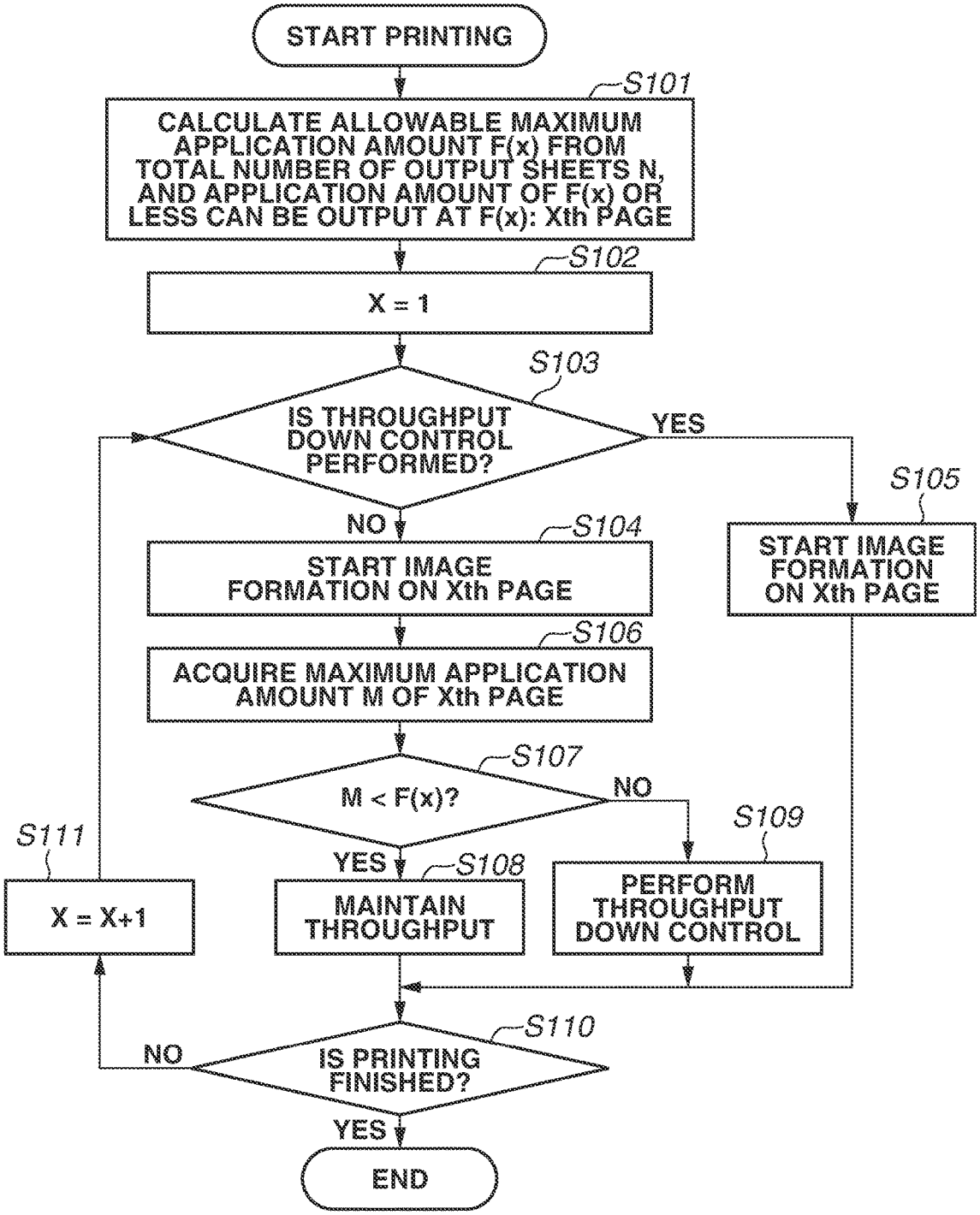
FIG. 11 is a flowchart illustrating a throughput control according to a second embodiment.

Next, the throughput control using the allowable maximum application amount F(x) will be described with reference to a throughput control flowchart illustrated in FIG. 11. This control operation is performed by the control circuit unit 90 illustrated in FIG. 5.

When printing is started, in step S101, the control circuit unit 90 calculates the allowable maximum application amount F(x) from the total number of output sheets N of the print reservation information input to the controller unit 100 from the network unit (data transmission device) 101, such as an external computer, and the operation unit 102, and then the processing proceeds to step S102.

In step S102, the number of image formations X is set as X=1, and then the processing proceeds to step S103.

In step S103, the control circuit unit 90 determines whether the throughput down control is performed. If it is determined that the throughput down control is not being performed (NO in step S103), the processing proceeds to step S104. If the control circuit unit 90 determines that the throughput down control is performed, the processing proceeds to step S105.

In step S104, the control circuit unit 90 starts image formation on an Xth page, and then the processing proceeds to S6.

In step S105, the control circuit unit 90 starts image formation on the Xth page, and then the processing proceeds to step S110.

In step S106, the control circuit unit 90 acquires the maximum application amount M on the Xth page. In step S107, the control circuit unit 90 compares the maximum application amount M and the allowable maximum application amount F(x).

In step S107, if M<F(x) holds (YES in step S107), the processing proceeds to step S108. If M F(x) holds (NO in step S107), the processing proceeds to step S109.

In step S108, the throughput is maintained (first throughput) and the control operation is performed at a throughput of 50 sheets per minute, and then the processing proceeds to step S110.

In step S109, the throughput down control (for controlling the throughput to be changed from the first throughput to the second throughput which is lower than the first throughput by the predetermined level) is performed and the control operation is performed at a throughput of 25 sheets per minute, and then the processing proceeds to step S110.

In step S110, if printing is finished (YES in step S110), the operation is terminated. If printing is not finished (NO in step S110), in step S111, the number of image formations X is recorded and updated with X+1 in the recording unit 91, and then the processing proceeds to step S103.

The second embodiment described above is summarized as follows. The acquisition unit (first acquisition unit) 1012 that acquires the maximum toner application amount per unit area of a toner image formed on a recording sheet is provided. The control circuit unit 90 (i.e., estimation unit; acquisition unit; second acquisition unit) that estimates, from the input print reservation information, the number of recording sheets to be stacked on the sheet discharge unit during printing or after the end of printing is provided. The control circuit unit 90 that controls the number of image formations per unit time based on the information acquired from the acquisition unit and the estimation unit is provided.

When the above-described control operation is applied to the first image forming job in which the number of recording sheets to be stacked on the same sheet discharge unit is N (e.g., N=800) and a toner image having the first amount as the maximum toner application amount per unit area is formed on each of the N recording sheets, and when the above-described control operation is applied to the second image forming job in which the number of recording sheets to be stacked on the same sheet discharge unit is N (e.g., N=800) and a toner image having the second amount more than the first amount as the maximum toner application amount per unit area is formed on each of the N recording sheets, the following operation is carried out. Specifically, in a period from an Lth sheet to an Mth sheet (e.g., a period from a 300th sheet to a 599th sheet) during the first image forming job, the control circuit unit 90 executes the first image forming job at the first throughput (the first number of image formations per unit time, e.g., 50 sheets per minute). Further, in the same period as that in the second image forming job, i.e., in the period from the Lth sheet to the Mth sheet (e.g., the period from the 300th sheet to the 599th sheet) during the second image forming job, the control circuit unit 90 executes the second image forming job at the second throughput (e.g., 25 sheets per minute) which is lower than the first throughput. In this case, L, M, and N are natural numbers and L<M<N holds.

With the configuration described above, it is possible to provide an image forming apparatus capable of preventing recording sheets stacked on the sheet discharge unit from adhering to each other, while preventing a deterioration in productivity.

Further, the control circuit unit 90 executes the second image forming job at a throughput (e.g., 50 sheets per minute) higher than the second throughput in a period from a first sheet to (L−1)th sheet (e.g., a period from a first sheet to a 299th sheet) in the second image forming job, thereby further preventing a deterioration in productivity.

Similarly, the control circuit unit 90 executes the second image forming job at a throughput (e.g., 50 sheets per minute) higher than the second throughput in a period from an (M+1)th sheet to an Nth sheet (e.g., a period from a 600th sheet to an 800th sheet) in the second image forming job, thereby further preventing a deterioration in productivity.

Further, the control circuit unit 90 executes the job at the first throughput (e.g., 50 sheets per minute) in a period from the first sheet to the Nth sheet (e.g., a period from the first sheet to the 800th sheet) in the first image forming job.

When the control circuit unit 90 executes a third image forming job in which the number of recording sheets to be stacked on the same sheet discharge unit is K (e.g., K=600) and a toner image having the second amount as the maximum toner application amount per unit area is formed on each of the K recording sheets, the number of sheets to be stacked is small, and thus the following operation may be performed. Specifically, the third image forming job is executed at a throughput (e.g., 50 sheets per minute) higher than the second throughput in a period from the first sheet to a Kth sheet including the period from the Lth sheet to the Mth sheet (e.g., the period from the 300th sheet to the 599th sheet) in the third image forming job. In this case, L, M, K, and N are natural numbers and L<M<K<N holds.

An allowable application amount acquisition unit (90) that acquires the allowable application amount of toner to be formed on each recording sheet stacked on the sheet discharge unit based on information acquired by the estimation unit (90) is provided. The control circuit unit 90 controls the number of image formations on sheets (which is also the number of sheets formed the toner images) per unit time based on the allowable application amount acquired by the allowable application amount acquisition unit (90) and the maximum toner application amount acquired by the acquisition unit.

The temperature detection unit A that detects the temperature of the sheet discharge unit and the stacking amount detection unit H that detects the stacking amount of recording sheets on the sheet discharge unit are provided. The estimation unit (90) estimates the temperature of the sheet discharge unit and the stacking amount during printing or after the end of printing based on the information acquired by the temperature detection unit and the stacking amount detection unit.

As described above, in the second embodiment, beneficial effects similar to those of the first embodiment can be obtained. In addition, the sheet bundle internal temperature of sheets to be stacked on the sheet discharge tray is estimated from the total number of output sheets N of the print reservation information, and the allowable maximum application amount F(x) is calculated only at the start of printing. Accordingly, the amount of calculation required for calculating the allowable maximum application amount per print job is smaller than that in the first embodiment, and there are no concerns about deterioration in First Copy Time (FCOT) due to an increase in processing time and occurrence of a delay in starting a print operation.

In the second embodiment, as a configuration capable of further preventing a deterioration in productivity, the second throughput (e.g., 25 sheets per minute) lower than the first throughput is set in the period from the Lth sheet to the Mth sheet during the image forming job in the second image forming job with a larger maximum toner application amount. However, the following configuration may also be employed. Specifically, in the second image forming job with a larger maximum toner application amount, the second throughput may be set in the period from the first sheet to the Nth sheet.

Other Embodiments (1) In the throughput control, the interval between sheets (sheet-to-sheet interval) may be controlled to be increased or decreased, while maintaining the process speed. Alternatively, the process speed (sheet conveyance speed) may be controlled to be increased or decreased, while maintaining the interval between sheets (sheet-to-sheet interval). A configuration for controlling the throughput of sheets to be conveyed to the fixing device and the subsequent devices may be employed.

(2) The fixing device 40 is not limited to the device having the configuration illustrated in the embodiments. In a pair of the rotary members (the belt 603 and the elastic pressure roller 70) that form the nip portion N, both the rotary members may be rollers, or one of the rotary members may be an endless belt (hollow body) and the other one of the rotary members may be a roller. Further, alternatively, both the rotary members may be endless belts. The heating unit of each rotary member may have a device configuration of a type in which internal heating or external heating is performed by the heating unit, such as a halogen lamp or a nichrome wire heater. Further, the rotary member may include an energization heat generating layer for energization and heating.

(3) The application of the fixing device 40 is not limited to a device for fixing an unfixed toner image formed on a sheet as a fixed image. The fixing device 40 is also effective as a device for adjusting the surface property of an image by, for example, heating and pressing the toner image, which is fixed onto a sheet once, or is temporarily fixed to a sheet, again to improve the glossiness of the image (such a device is also referred to as a fixing device).

(4) The digital image forming apparatus is not limited to an image forming apparatus that forms a full-color image, like in the embodiments, and instead may be an image forming apparatus that forms a monochrome image. Further, the image forming apparatus can be implemented, by adding necessary devices, equipment, and casing structures, in various applications, such as a copying machine, a facsimile (FAX) machine, and a multifunction peripheral including a plurality of such functions.

(5) The image forming process of the image forming apparatus is not limited to the electrophotographic process. A toner image can be formed on a recording material by a transfer method or a direct method using another image formation process such as an electrostatic recording process or a magnetic recording process.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Applications No. 2017-141666, filed Jul. 21, 2017, and No. 2018-099406, filed May 24, 2018, which are hereby incorporated by reference herein in their entirety.

What is claimed is:

1. An image forming apparatus comprising:

an image forming unit configured to form a toner image on a sheet;

a fixing unit configured to heat and fix the toner image formed on the sheet by the image forming unit;

a sheet discharge unit capable of stacking a plurality of sheets to be discharged through the fixing unit;

an acquisition unit configured to acquire information corresponding to a maximum toner application amount per unit area of the toner image formed on the sheet; and a controller configured to control the number of image formations on the plurality of sheets per unit time based on the information acquired by the acquisition unit, wherein, in a case where a first job for forming a first toner image having a first amount as the maximum toner application amount per unit area on each of N sheets and stacking the N sheets on the sheet discharge unit is executed, the controller executes the first job with a first number of image formations on the plurality of sheets per unit time during a period from an Lth sheet to an Mth sheet in the first job, where L, M, and N are natural numbers and $L<M<N$ holds, and wherein, in a case where a second job for forming a second toner image having a second amount more than the first amount as the maximum toner application amount per unit area is formed on each of the N sheets by the image forming unit and stacking the N sheets on the sheet discharge unit is executed, the controller executes the second job with a second number of image formations less than the first number of image formations on the plurality of sheets per unit time during the period from the Lth sheet to the Mth sheet in the second job.

2. The image forming apparatus according to claim 1, wherein, in a case where the second job is executed, the controller executes the second job with a number of image formations more than the second number of image formations per unit time during a period from a first sheet to an (L−1)th sheet.

3. The image forming apparatus according to claim 1, wherein, in a case where the second job is executed, the controller executes the second job with a number of image formations more than the second number of image formations per unit time during a period from an (M+1)th sheet to an Nth sheet.

4. The image forming apparatus according to claim 1, wherein, in a case where the first job is executed, the controller executes the first job with the first number of image formations on the plurality of sheets per unit time during a period from a first sheet to an Nth sheet.

5. The image forming apparatus according to claim 1, wherein, in a case where the number of sheets to be stacked on the sheet discharge unit is represented by K, which is smaller than the number N, and a third job for forming a toner image having the second amount as the maximum toner application amount per unit area on each of the K sheets is executed, the controller executes the third image forming job with a number of image formations more than the second number of image formations on the plurality of sheets per unit time during a period from the Lth sheet to the Mth sheet in the third image forming job, where K is a natural number and $L<M<K<N$ holds.

6. The image forming apparatus according to claim 1, further comprising a second acquisition unit configured to acquire the number of sheets to be stacked on the sheet discharge unit.

7. An image forming apparatus comprising:

an image forming unit configured to form a toner image on a sheet;

a fixing unit configured to heat and fix the toner image formed on the sheet by the image forming unit;

a sheet discharge unit capable of stacking, in an overlapped manner, a plurality of sheets to be discharged through the fixing unit;

an acquisition unit configured to acquire information corresponding to a maximum toner application amount per unit area of the toner image formed on the sheet; and a controller configured to control the number of image formations on the plurality of sheets per unit time based on the information acquired by the acquisition unit, wherein, in a case where a first job for forming a first toner image having a first amount as the maximum toner application amount per unit area on each of N sheets and stacking the N sheets on the sheet discharge unit is executed, the controller executes the first job with a first number of image formations on the plurality of sheets per unit time, where N is a natural number, and wherein, in a case where a second job for forming a second toner image having a second amount more than the first amount as the maximum toner application amount per unit area is formed on each of the N sheets by the image forming unit and stacking the N sheets on the sheet discharge unit is executed, the controller executes the second job with a second number of image formations less than the first number of image formations on the sheets per unit time.

8. An image forming apparatus comprising:

an image forming unit configured to form a toner image on a sheet;

a fixing unit configured to heat and fix the toner image formed on the sheet by the image forming unit;

a sheet discharge unit capable of stacking, in an overlapped manner, a plurality of sheets to be discharged through the fixing unit;

an acquisition unit configured to acquire information corresponding to a maximum toner application amount per unit area of the toner image formed on the sheet; and a controller configured to control the number of image formations on the plurality of sheets per unit time based on the information acquired by the acquisition unit, wherein, in a case where a first job for forming a toner image having a first amount as the maximum toner application amount per unit area on each of a plurality of sheets and discharging the plurality of sheets onto the sheet discharge unit is executed with a first number of image formations on the plurality of sheets per unit time, if the number of sheets stacked on the sheet discharge unit reaches a first stacking number of sheets, the controller reduces the number of image formations per unit time in the first image forming job, and wherein, in a case where a second job for forming a toner image having a second amount less than the first amount as the maximum toner application amount per unit area on each of a plurality of sheets and discharging the plurality of sheets onto the sheet discharge unit is executed with the first number of image formations on the plurality of sheets per unit time, when the number of sheets stacked on the sheet discharge unit reaches the first stacking number of sheets, the controller does not reduce the number of image formations on the plurality of sheets per unit time in the second image forming job.

9. The image forming apparatus according to claim 8, further comprising a detection unit configured to detect the number of sheets stacked on the sheet discharge unit, wherein the controller controls the number of image formations per unit time based on an output from the detection unit.

* * * * *